US006320112B1

(12) United States Patent
Lotze

(10) Patent No.: US 6,320,112 B1
(45) Date of Patent: Nov. 20, 2001

(54) PROCEDURE AND DEVICE FOR THE AUTOMATIC SELECTION OF MUSICAL AND/OR TONAL COMPOSITIONS

(76) Inventor: Martin Lotze, Jakob-Kaiser-Strasse 3, D-26386 Wilhelmshaven (DE)

( * ) Notice: Subject to any disclaimer, the term of this patent is extended or adjusted under 35 U.S.C. 154(b) by 0 days.

(21) Appl. No.: 09/861,242

(22) Filed: May 18, 2001

(30) Foreign Application Priority Data

May 19, 2000 (DE) ..... 200 09 085 U
Sep. 22, 2000 (DE) ..... 100 47 052

(51) Int. Cl.[7] ..... G10H 1/18; G10H 7/00

(52) U.S. Cl. ..... 84/615; 84/600; 84/618; 84/653; 84/656; 84/477 R

(58) Field of Search ..... 84/600, 601–603, 84/609–612, 615, 618, 626, 633, 649–653, 656, 662, 665, 666–668, 477 R, DIG. 2; 434/307 A

(56) References Cited

U.S. PATENT DOCUMENTS 5,310,962 * 5/1994 Kimpara et al. ..... 84/600
5,471,009 * 11/1995 Oba et al. ..... 84/600
6,084,169 * 7/2000 Hasegawa et al. ..... 84/600
6,201,176 * 3/2001 Yourlo ..... 84/609

FOREIGN PATENT DOCUMENTS 44 32 632 3/1996 (DE) .
195 23 515 1/1998 (DE) .

* cited by examiner

*Primary Examiner*—Marlon T. Fletcher
(74) *Attorney, Agent, or Firm*—Collard & Roe, P.C.

(57) ABSTRACT

A process for the automatic selection of musical or tonal compositions to be replayed from a collection of musical or tonal compositions includes the step of assigning evaluation data to each of said compositions which describe its characteristics. Parameters are established describing a target corresponding to a selected behavior of an audience. Status data is generated based on an evaluation of audience behavior. The parameters are then compared with the status data to generate requirement data based on the comparison. The requirement data is compared with the evaluation data and a composition is selected based on the comparison of the requirement data with the evaluation data. A device is also provided for the automatic selection of musical or tonal compositions.

17 Claims, 2 Drawing Sheets

PROCEDURE AND DEVICE FOR THE AUTOMATIC SELECTION OF MUSICAL AND/OR TONAL COMPOSITIONS

BACKGROUND OF THE INVENTION

1. Field of the Invention

The present invention relates to a procedure for the automatic selection of musical and/or tonal compositions to be replayed from a collection of musical and/or tonal compositions. In addition, the invention relates to a device for the automatic selection of musical and/or tonal compositions from a collection of musical and/or tonal compositions by means of a computing device.

2. The Prior Art

Known in the art are programs that permit a manual sequencing of musical compositions to be played. Additionally known are programs that arbitrarily select musical compositions at random.

DE 44 32 632 A1 discloses a system for the automatic output of voice responses in response to input voice signals. In particular, it describes an automatic information system, with which individuals can receive information through inquiries, without another operator being necessary.

Known from DE 195 23 515 C2 are a procedure and a device for the transmitter-based detection of responses by a specific listener to a transmitter message sent by a radio or television transmitted with the broadcast program. In this case, the listener responds to the transmitted message by entering data in a data input device on the listener side.

At functions, e.g., celebrations or in discotheques, a disk jockey is normally present to manually select the musical and/or tonal compositions. The selection and sequence of musical and/or tonal compositions to be played greatly influences the mood of the audience. Development of a positive mood increases the popularity of a discotheque, for example, and hence sales. For this reason, disk jockeys become very important in the highly sales oriented catering industry. Therefore, a good disk jockey combines long years of experience on the job, good knowledge of music and a keen sense of empathy. He must be perfectly versed in as wide a selection of music as possible. The musical compositions usually involve various forms of popular music, in particular rock or hit music, arranged in numerous style categories, e.g., rock 'n' roll, heavy metal or disco. The tonal compositions, e.g., jingles or background sounds, can include any conceivable types.

SUMMARY OF THE INVENTION

The object of the present invention is to create a procedure and a device to enable an automatic and target-oriented selection of musical and/or tonal compositions to be replayed.

According to the invention, each musical and/or tonal composition is assigned evaluation data that describe its characteristics. Setting parameters are set up to describe a target describing a selected or desired behavior of an audience. Status data are acquired or generated while evaluating the behavior of an audience. The setting parameters and status data are compared, and requirement data are generated or acquired from that. The requirement data are compared with the evaluation data of the musical and/or tonal compositions, and a suitable musical or tonal composition is selected. In this way, a musical composition best suited to the respective situation can be selected entirely automatically.

The procedure according to the invention preferably assigns or allocates several evaluation data to each musical and/or tonal composition in a collection. This allocation encompasses the automatic allocation of evaluation data relating to constant criteria, e.g. instrument arrangement, volume fluctuation or beat, of a musical or tonal composition newly incorporated into the musical collection. It also encompasses the interactive allocation of evaluation data for variable criteria, e.g., popularity of the composition or its tendency to inspire dancing. DE 197 24 376 C2 describes one possibility with respect to the allocation of evaluation data with constant criteria.

It makes sense to acquire as high a number of evaluation data from as many criteria as possible. For example, the evaluation data can be arranged by their criteria. criteria for musical compositions can include style of music, type of beat, beat, instruments, popularity, year of release, dancing inspiration or song repeats, while those for tonal compositions can included play duration, sound sources or achievable listener emotions. Evaluation data, e.g., for the type of beat criterion, are 4/4 beat or 3/4 beat.

The setting parameters are preferably in the same form as the evaluation data, and in particular of the status data, since this effectively enables a comparison between a setting parameter that describes dance behavior, and status data, e.g., those acquired about a camera view of the dance floor. To describe a specific target concept in a target stipulation, setting parameters are established or selected. The number of established or selected setting parameters here depends on the scope of the envisaged target.

The status data acquired from evaluating the behavior of an audience reflect the current status of the audience and/or its environment at any given time.

The requirement data acquired from the setting parameters and status data here correspond to the result of a continuously ongoing actual/set interrogation. Preferably, the comparison between the requirement data and the evaluation data for the musical and/or tonal compositions results in the selection of the musical or tonal composition in which the correlation between evaluation data and requirement data is as great as possible.

Given identical or comparable correlation values for several musical or tonal compositions, a musical or tonal composition may be selected randomly or by some other method.

In addition, the behavior of an audience is used to reevaluate the evaluation data allocated to the musical and/or tonal compositions. Since the behavior of an audience observed over any period of time yields a behavioral progression, the evaluation data acquired from the behavior of an audience represent certain evaluation levels. The composition of these evaluation levels constantly changes during a reevaluation.

The requirement data acquired from the setting parameters and status data are also used to establish a sequence of musical and/or tonal compositions to be replayed, and also to automatically control the volume. It is also possible to control all other parameters in this way, e.g., balance or individual frequency amplifications, in particular base and amplitude frequencies.

The requirement data acquired from audience behavior are preferably also used for automatically controlling a special effects system, e.g., a light or fog generating system.

The musical and sound compositions and their evaluation data preferably comprise an evaluation matrix. The advantage to a matrix is that all data can be compared and evaluated by a computing device in the form of lines and columns.

According to the invention the device consists of a device for observing an audience and a computing device, in particular a computer. The computer has the task of evaluating the information obtained from the audience observing device, compare it with setting parameters, and select a musical or tonal composition. Memory areas are allocated for storing the evaluation data, which are linked with memory areas for storing the musical and/or tonal compositions in such a way as to enable an allocation. In addition, memory areas are provided for storing the setting parameters for a predeterminable period. The status data and requirement data can also be stored over the chronological progression. The computing device of the computer evaluates the correlation between status data and setting parameters to generate requirement data, and evaluates the correlation between requirement data and evaluation data to select a musical or tonal composition, and to control various systems.

The listener-observing device preferably has at least one camera. Depending on how large the area to be observed and number of required camera settings, several cameras may become necessary, For example, the camera can be aimed at an area of the dance floor, wherein the images it supplies are evaluated by the computer for movement. The cameras can also be aimed at entrance areas to record increasing or decreasing audience numbers, or at hallways, to ascertain the audience flow at an event, in particular in cases where different music is being played in different rooms. Also conceivable are cameras that focus in on sitting areas, counters or lobbies with a high or low noise level. Depending on the location, directional orientation and focal setting of the camera, any general or detailed movements of an audience can be recorded. In addition, detailed evaluations can also be made by localizing the entire supplied image with the computer.

In a further development of the invention, the audience-observing device has at least one microphone. Depending on the size of the area to be monitored and number of required monitoring settings, several microphones may he necessary here as well. The microphone can be aimed at any location, wherein the computer also evaluates the sounds it provides by entertainment activity. Depending on the location, directional orientation and recording parameters of a microphone, any general or partial acoustics can here also be recorded.

The audience-observing device preferably has at least one thermometer. Depending on the size of the area to be observed and numbers of required measuring points, several thermometers might be necessary. For example, the thermometer can measure the ambient temperature in the area of a dance floor. Depending on the positioning of the thermometer, any ambient temperatures and/or local temperatures can here be recorded as well.

In a further development of the invention, the audience-observing device has at least one hygrometer. Humans perceive ambient temperature through the thermal conductivity of the air, which largely depends on humidity. Hence, the hygrometer is preferably installed together with a thermometer for measuring the ambient temperature in the same location.

The audience-observing device beneficially comprises at least one device for measuring oxygen content in the air. For example, being aware of low oxygen content in the air makes it possible to select slower musical compositions or supply fresh air. Other measuring devices can also be used, e.g., for measuring the carbon monoxide content in the air.

In another further development of the invention, the audience-observing device has sensors for recording body data for one or more individuals in the audience. The sensors generally are functional or structural elements used to acquire physical, chemical or electrochemical variables from physical or chemical effects, and convert them into electrical signals. The sensors can basically be placed anywhere, but are particularly suited for attachment to individuals in an audience. The sensors have miniature dimensions and therefore pose little inconvenience to an individual to whom they are attached. Therefore, a wide range of body functions can be monitored or measured. Bodily functions of relevance for the invention include perspiration and pulse rate.

The device according to the invention for the automatic selection of musical and/or tonal compositions has a device for manually changing the setting parameters. Such a change in setting parameters can be made both during and before or after the music or sounds have been replayed.

BRIEF DESCRIPTION OF THE DRAWINGS

Other objects and features of the present invention will become apparent from the following detailed description considered in connection with the accompanying drawings. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
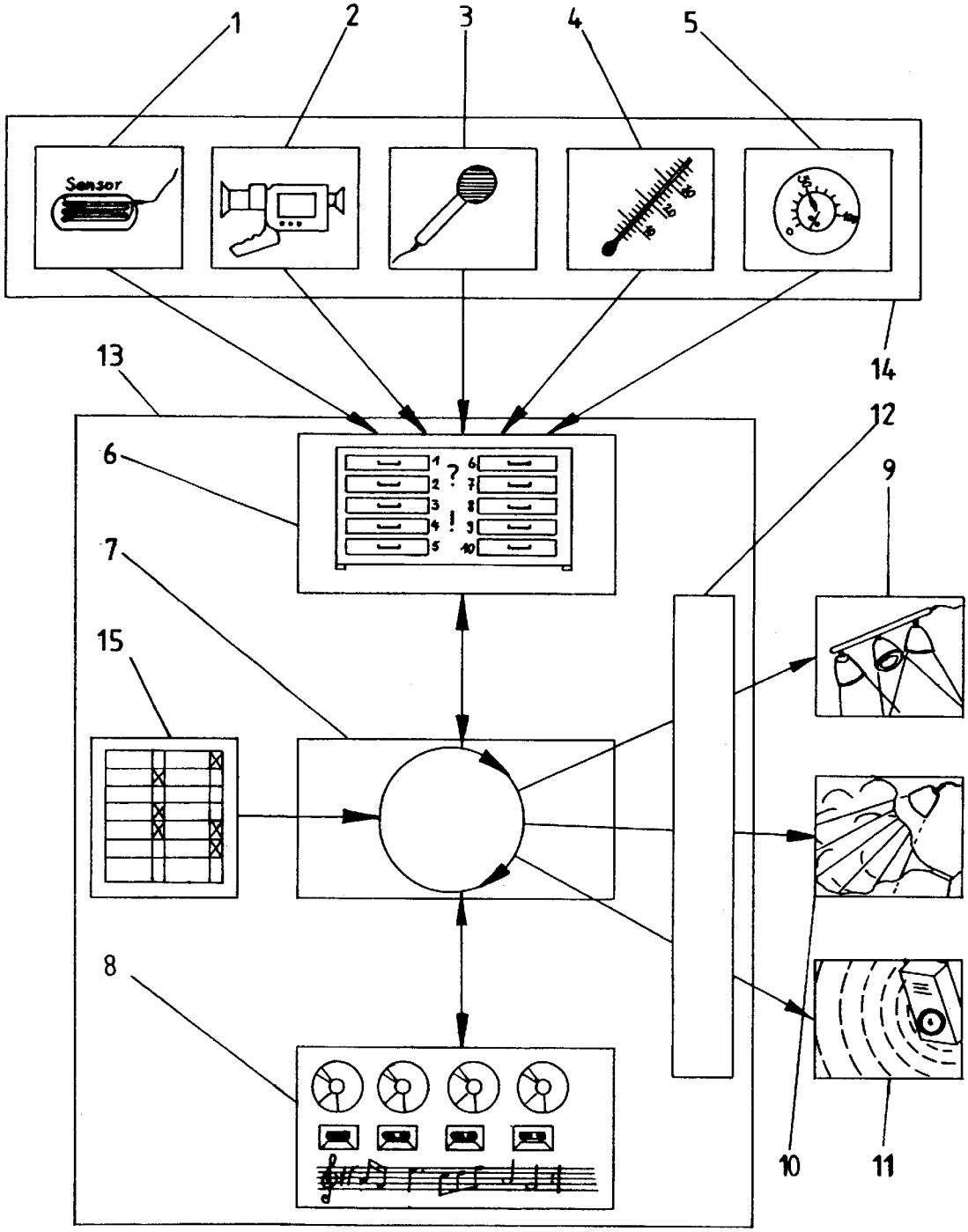
FIG. 1 shows an array of software and hardware for automatic and/or interactive selection of musical and/or tonal compositions to be replayed.

Referring now in detail to the drawings and, in particular, FIG. 1 shows an array of software and hardware for the interactive selection of musical and/or tonal compositions to be replayed. A computer 13 includes five units: an evaluator 6, a selector/controller 7, at least one database 8, a target input device 15, and at least one digital/analog converter 12. Evaluator 6 evaluates the data received from the data measuring or recording devices 14 based on programmable parameters. Selector/controller 7, constitutes the central processor of the overall system. The at least one database 8 contains status data, setting parameters, requirement data, a collection of musical and tonal compositions and their evaluation data. Target input device 15 enables the entry of a target stipulation via setting parameters. Evaluator 6 draws its data from various data measuring or recording devices 14, which are used to observe the listeners. Specifically, data measuring or recording devices 14 shown schematically in FIG. 1 depict a sensor 1, which can be placed in any inconspicuous location, in particular on individuals in the audience, a camera 2 for any observation area desired, a microphone 3 for any monitoring area desired, a thermometer 4 for any measuring point or area desired, and a hygrometer 5 for measuring the relative humidity in any area desired, in particular for a measured value combination with thermometer 4.

Evaluator 6 has the task of evaluating the recorded parameters provided by data measuring or recording devices 14 based on status data, and evaluating the status data with the setting parameters of target input device 15 based on the requirement data. Selection and control unit 7 reconciles the requirement data provided by evaluator 6 with the evaluation data for the musical and/or tonal compositions in database 8, and selects a musical or tonal composition. The individual steps are here preferably carried out in an intersection procedure.

The musical and tonal compositions in database 8 can include songs, jingles or background noises, whose evaluation data are allocated in evaluation matrices. Selection and control unit 7 also controls a lighting system 9, a special effects system such as a fogging system 10, and a music system 11. In this case, at least one digital/analog converter 12 is connected between selection and control unit 7 and systems 9 to 11. The parameters necessary for controlling systems 9 to 11 are also taken from evaluator 6, which is constantly transferring data with data measuring or recording devices 14.

Figure 2:
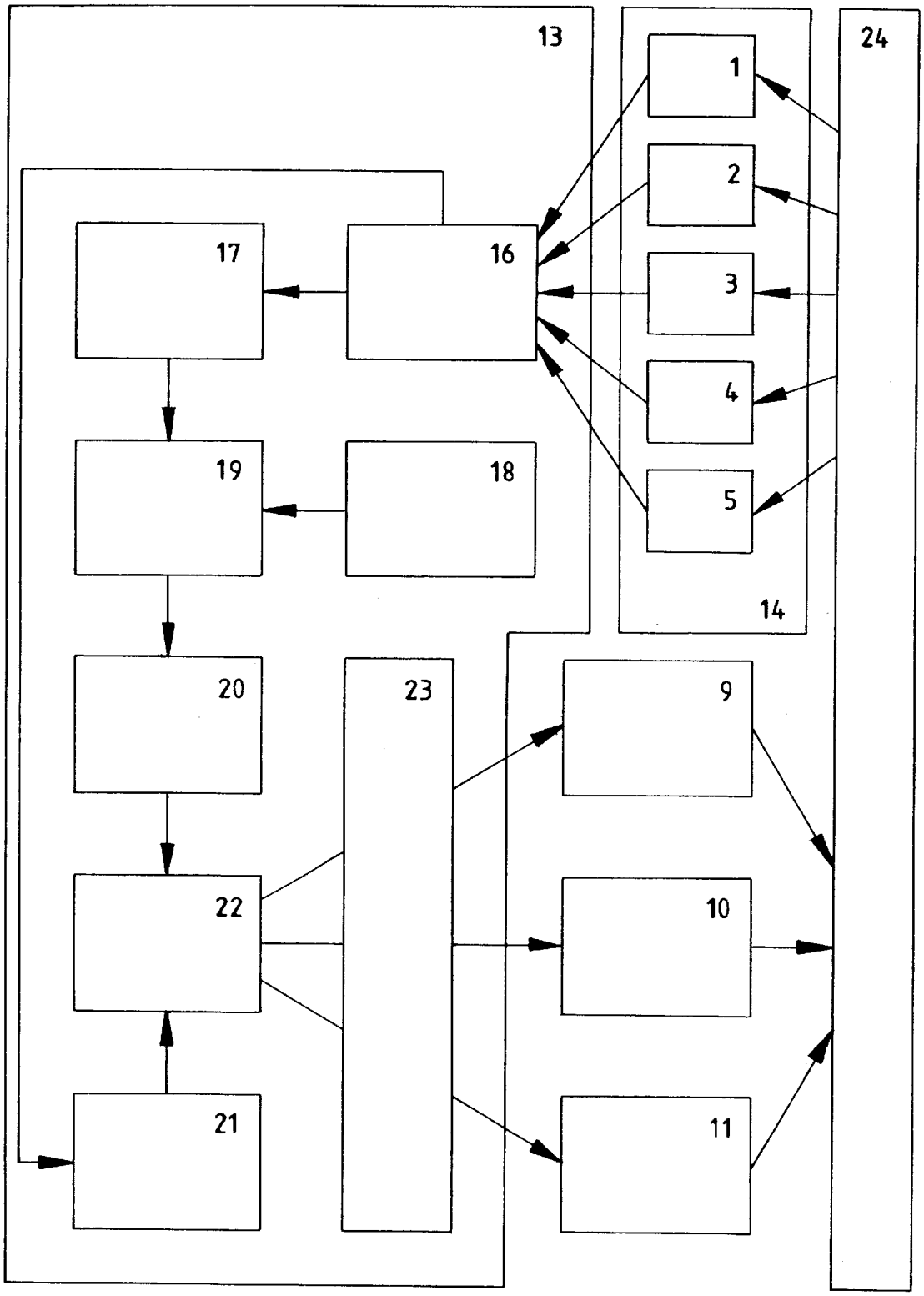
FIG. 2 shows a diagrammatic view of the process according to the invention.

The diagrammatic view of the procedure according to the invention shown on FIG. 2 depicts an audience 24 being monitored by the data measuring or recording devices 14. Data measuring or recording devices 14 comprise a sensor 1, a camera 2, a microphone 3, a thermometer 4 and a hygrometer 5. Data measuring or recording devices 14 relay their recorded parameters to computer 13, where they are evaluated to generate status data 17 in step 16. In addition, the evaluation in step 16 serves to reassess the evaluation data 21 for the musical and/or tonal compositions. Status data 17 are evaluated together with setting parameters 18 in step 19 to generate requirement data 20. Requirement data 20 are reconciled with the evaluation data 21 for the tonal and musical composition in step 22, a suitable tonal and musical composition is selected, whose digital data are allocated to systems 9 to 11 and converted into analog parameters in step 23. At this point, the parameters exit computer 13 and control lighting system 9, special-effects system 10 and music system 11. A change in operating parameters for systems 9 to 11 brings about a behavioral change in audience 24, which is in turn detected by data measuring and recording devices 14.

Accordingly, while a few embodiments of the present invention have been shown and described, it is to be understood that many changes and modifications may be made thereunto without departing from the spirit and scope of the invention as defined in the appended claims.

What is claimed is:

1. A process for the automatic selection of musical or tonal compositions to be replayed from a collection of musical or tonal compositions, which comprises the steps of:

(a) assigning evaluation data to each of the compositions, said evaluation data for a respective composition describing characteristics of the composition;

(b) establishing parameters describing a target corresponding to a selected behavior of an audience;

(c) generating status data based on an evaluation of audience behavior;

(d) comparing said parameters and said status data to generate requirement data based on the comparison;

(e) comparing said requirement data with the evaluation data for said compositions; and (f) selecting a composition based on the comparison of said requirement data with the evaluation data.

2. The process according to claim 1, wherein a plurality of evaluation data is acquired from a variety of criteria.

3. The process according to claim 1, wherein said step of selecting a composition comprises selecting the composition having the greatest correlation between said evaluation data and said requirement data.

4. The process according to claim 1, further comprising the step of using audience behavior to reassess said evaluation data assigned to the compositions.

5. The process according to claim 1, wherein said requirement data are used to establish a sequence of compositions to be replayed.

6. The process according to claim 1, further comprising the step of using said requirement data to automatically control the volume of the compositions to be replayed.

7. The process according to claim 1, further comprising the step of using said requirement data to automatically control at least one special-effects system.

8. The process according to claim 1, wherein a musical or tonal composition is selected at random from several of the compositions having a comparable correlation between said evaluation data and said requirement data.

9. The process according to claim 1, further comprising the step of forming at least one evaluation matrix from the compositions and their respective evaluation data.

10. A device for the automatic selection of musical or tonal compositions to be replayed from a collection of musical or tonal compositions, which comprises:

(a) at least one audience-observing device for observing an audience;

(b) a computing device coupled to the audience-observing device for evaluating information obtained from said audience-observing device, said computing device setting parameters describing a target corresponding to a selected audience behavior, comparing said information with said parameters, and selecting a composition based on the comparison.

11. The device according to claim 10, wherein said audience-observing device has at least one camera.

12. The device according to claim 10, wherein said audience-observing device has at least one microphone.

13. The device according to claim 10, wherein said audience-observing device has at least one thermometer.

14. The device according to claim 10, wherein said audience-observing device has at least one hygrometer.

15. The device according to claim 10, wherein said audience-observing device has at least one device for measuring the oxygen content in the air.

16. The device according to claim 10, wherein said audience-observing device has sensors for recording body data for one or more members of the audience.

17. The device according to claim 10, further comprising a device for manually changing said parameters.

* * * * *